US009731335B2

(12) United States Patent
Meisenzahl

(10) Patent No.: US 9,731,335 B2
(45) Date of Patent: Aug. 15, 2017

(54) VORTEX BAFFLE FOR A VENTILATED ENCLOSURE

(71) Applicant: Lawrence Robert Meisenzahl, New Castle, DE (US)

(72) Inventor: Lawrence Robert Meisenzahl, New Castle, DE (US)

( * ) Notice: Subject to any disclaimer, the term of this patent is extended or adjusted under 35 U.S.C. 154(b) by 776 days.

(21) Appl. No.: 13/621,798

(22) Filed: Sep. 17, 2012

(65) Prior Publication Data

US 2013/0090049 A1 Apr. 11, 2013

Related U.S. Application Data

(60) Provisional application No. 61/543,673, filed on Oct. 5, 2011.

(51) Int. Cl.
*B08B 15/02* (2006.01)
*F24F 7/00* (2006.01)

(52) U.S. Cl.
CPC ..... *B08B 15/023* (2013.01); *F24F 2007/001* (2013.01)

(58) Field of Classification Search
CPC ... B08B 15/02; B08B 15/023; F24F 2007/001
USPC ..... 454/49, 56, 61
See application file for complete search history.

(56) References Cited

U.S. PATENT DOCUMENTS 2,576,008 A * 11/1951 Gladfelter ..... B24C 7/0007 312/1
3,496,857 A * 2/1970 Ellis ..... B08B 15/023 454/57
3,726,206 A * 4/1973 Worick, Jr. ..... B08B 15/023 454/56
3,745,908 A * 7/1973 Mayberry ..... 454/57
3,943,836 A * 3/1976 Kuechler ..... F24C 15/20 126/299 D
4,047,519 A * 9/1977 Nett ..... 126/299 D
4,553,475 A * 11/1985 Saunders ..... B08B 15/023 454/57
4,822,385 A * 4/1989 Strege ..... F24C 15/20 126/299 D
4,860,643 A * 8/1989 Spearow ..... B08B 15/023 126/299 R
5,713,346 A * 2/1998 Kuechler ..... F24C 15/2021 126/299 D (Continued)

*Primary Examiner* — Gregory Huson
*Assistant Examiner* — Dana Tighe
(74) *Attorney, Agent, or Firm* — Lyman Smith

(57) ABSTRACT

A ventilated enclosure includes a vortex baffle to harness the turbulence of air in a way that uses less exhaust air while still providing ample protection to the user. The vortex ventilation system uses the total interior shape and proportion of the ventilated enclosure to direct the motion of air flow in a manner that improves efficiency. The vortex ventilation baffle can enhance the way air naturally curls, or rolls, as air flows through the enclosure. The vortex baffle can cause a mono-stable vortex to from in the enclosure. This vortex is resilient to disturbances that cause ventilated enclosures, such as chemical fume hoods, to spill. The stable vortex is above the work surface and less affected by the way apparatus is loaded inside the enclosure. The vortex baffle achieves better containment (improved safety) at lower exhaust flow (improved energy consumption) as compared to conventional ventilated enclosures.

11 Claims, 1 Drawing Sheet

(56) References Cited

U.S. PATENT DOCUMENTS

| | | | | |
|---|---|---|---|---|
| 5,816,906 | A * | 10/1998 | Mai | A45D 29/00 454/56 |
| 5,924,920 | A | 7/1999 | DeLuca et al. | |
| 6,089,970 | A * | 7/2000 | Feustel | 454/57 |
| 6,428,408 | B1 * | 8/2002 | Bell et al. | 454/56 |
| 2005/0202777 | A1 * | 9/2005 | Worland | B08B 15/023 454/339 |
| 2011/0117828 | A1 * | 5/2011 | Huang | 454/65 |

* cited by examiner

VORTEX BAFFLE FOR A VENTILATED ENCLOSURE

CROSS-REFERENCE TO RELATED APPLICATION

This application claims the benefit of priority of U.S. provisional application No. 61/543,673, filed Oct. 5, 2011, the contents of which are herein incorporated by reference.

BACKGROUND OF THE INVENTION

The present invention relates to ventilated enclosures and, more particularly, to a ventilated enclosure having a vortex baffle to efficiently provide ventilation to an enclosure, such as a chemical fume hood.

A chemical fume hood is a highly specialized ventilated enclosure. It is a secondary safety device intended to contain fumes and vapors that may be harmful or noxious to a user standing in front of the hood or enclosure. A volume of air is passed through the hood or enclosure to carry fumes and vapors away from the user. Operations or chemistry that produce harmful or noxious fumes are done inside a chemical fume hood. A person using the hood will reach inside the hood to manipulate the operation or chemistry being conducted. The chemical fume hood is intended to protect a person's nose and mouth area from substances at an arm's length. Chemical fume hoods have a sash that may be opened or closed. The sash is a physical barrier between the person and the interior of the hood. A chemical fume hood is used by positioning the sash and the sash may be opened, closed or anywhere in between.

Conventional fume hoods have baffles that create slots through which exhaust air flows. Traditional baffles have two exhaust slots, one in the top and one at the bottom, near the work surface. Some fume hoods have a middle slot. Air flow through these slots can become impeded by equipment and apparatus used in the fume hood.

Air flowing through an enclosure with an arbitrary interior shape is chaotic. Ventilated enclosures, such as chemical fume hoods, are safety devices intended to contain harmful airborne substances inside the enclosure. Fume hoods tend to spill due to external forces, such as the way the make-up air enters the room and movements of a person using the enclosure. Hood containment is disrupted by the way apparatus is loaded inside of the fume hood.

The only solution to poor hood performance has been to increase air flow, resulting in increased energy costs. Thus, current ventilated enclosures are inefficient because too much air is exhausted to provide too little protection to the user.

As can be seen, there is a need for an improved ventilated enclosure design that can provide user protection from fumes spilling out of the enclosure while minimizing the needed air flow to do so.

SUMMARY OF THE INVENTION

In one aspect of the present invention, a ventilated enclosure comprises an opening to permit a user access to an interior of the ventilated enclosure; a symmetrical vaulted interior ceiling inside the ventilated enclosure; and a single exhaust slot disposed between the symmetrical vaulted interior ceiling and a rear housing of the ventilated enclosure.

In another aspect of the present invention, a ventilated enclosure comprises an opening to permit a user access to an interior of the ventilated enclosure; a symmetrical vaulted interior ceiling inside the ventilated enclosure; and a single exhaust slot disposed between the symmetrical vaulted interior ceiling and a rear housing of the ventilated enclosure, wherein an interior height of the enclosure is equal to about 1.6 times a working depth of the enclosure; the working depth of the enclosure is equal to a distance from a work surface to the single exhaust slot; and a height of the opening is equal to or less than the working depth of the enclosure.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a ventilated enclosure that includes a vortex baffle to harness the turbulence of air in a way that uses less exhaust air while still providing ample protection to the user. The vortex ventilation system uses the total interior shape and proportion of the ventilated enclosure to direct the motion of air flow in a manner that improves efficiency. The vortex ventilation baffle can enhance the way air naturally curls, or rolls, as air flows through the enclosure. The vortex baffle can cause a mono-stable vortex to from in the enclosure. This vortex is resilient to disturbances that cause ventilated enclosures, such as chemical fume hoods, to spill. The stable vortex is above the work surface and less affected by the way apparatus is loaded inside the enclosure. The vortex baffle achieves better containment (improved safety) at lower exhaust flow (improved energy consumption) as compared to conventional ventilated enclosures.

Figure 2:
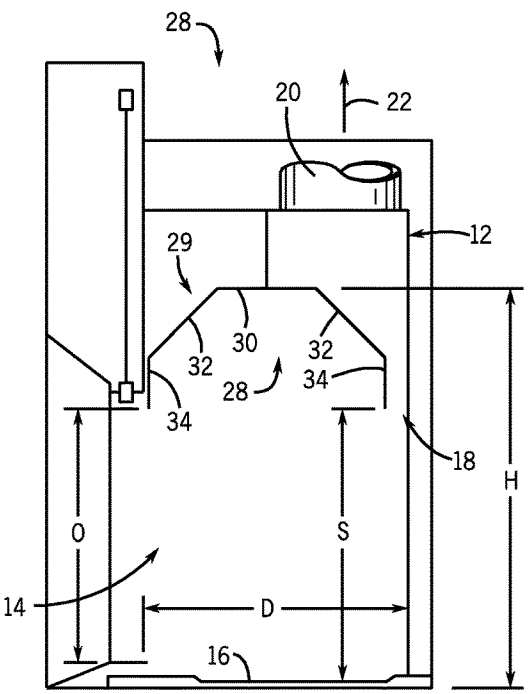
FIG. 2 is a schematic cross-sectional view of a ventilated enclosure according to another exemplary embodiment of the present invention.
Figure 1:
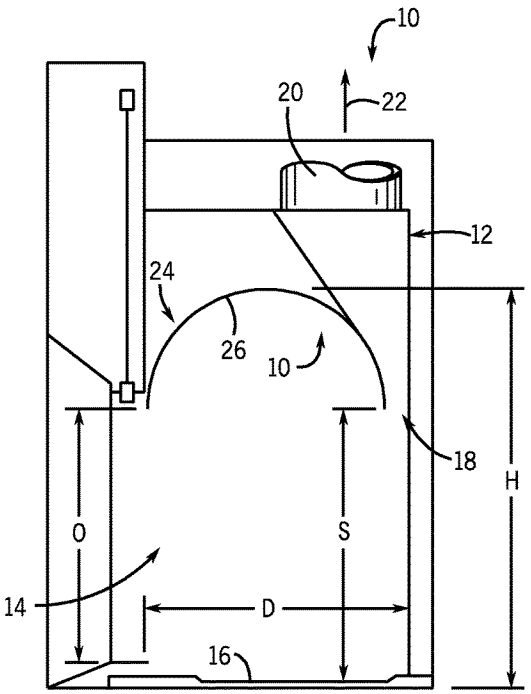
FIG. 1 is a schematic cross-sectional view of a ventilated enclosure according to an exemplary embodiment of the present invention.

Referring now to FIGS. 1 and 2, a fume hood 10, 28 can include a vortex ventilation baffle 24, 29 disposed as a rigid structure at a top region of the fume hood 10. The ventilation baffle 24 may have an arc shape 26. The ventilation baffle 29 may have a vaulted shape defined vertical components 34 interconnecting with a horizontal component 30 via sloped components 32, as described in greater detail below. The ventilation baffles 24, 29 includes a single exhaust slot 18 in the upper rear of the hood.

Air flow 14 can enter the fume hood 10, 28 through an intake opening O. The height of the intake opening O may be controlled by a sash or may be fixed, depending on the configuration of the ventilation enclosure. The air flow that is not immediately exhausted through the slot, encounters a symmetrical vaulted interior ceiling (such as vortex ventilation baffle 24, 29). Air flows around the vaulted space at the top and rolls down the top interior front of the hood to meet air entering from outside of the hood. This mixing of air from inside and outside the hood induces and enhances the stable vortex that forms in the upper portion of the hood. The motion of the stable vortex can keep air moving through the open face and away from a person using the hood. The vortex effect improves the containment (and, thus, safety) of fumes inside the hood while using a relatively low exhaust air flow.

The exhaust air flow can be taken out through the sole exhaust slot 18, through an exhaust duct 20 to be expelled as exhaust 22. As exhaust 22 is removed, new air flow 14 enters, sustaining the vortex.

The vaulted ventilated top (also referred to as the vortex ventilation baffle 24) can have an arc shape 26, typically a semi-circular arc shape, as shown in FIG. 1. In some embodiments, the vortex ventilation baffle 29 can be formed from flat surfaces with corners angled at 45 degrees. The vortex ventilation baffle 29 is designed as a symmetrical vaulted interior ceiling having the vertical components 34 at the front and back, with slanted components 32 extending from a top edge of the vertical components 34. The slanted components 32 connect with the horizontal component 30. In the dimension shown in FIG. 2, baffle components 30, 32 and 34 should be the same length. Other designs are contemplated within the scope of the present invention, provided that they provide a symmetrical vaulted interior ceiling with a single exhaust slot 18 formed where the rearward vertical component 34 is adjacent to the housing 12 of the hood 28.

In an exemplary embodiment of the present invention, the total interior height H of the enclosure can be configured to be about 1.6 times the working depth D of the enclosure. The single exhaust slot 18 can be located a distance S above a work surface 16. The distance S can be equal to the working depth D of the enclosure. The height of the intake opening O can be equal to or less than the working depth D of the hood.

The vortex ventilation baffle 24, 29 can be made using conventional techniques and can be fabricated from various sheet materials, such as metal, glass, fiberglass, plastic (Lexan, for example), composite resin or the like.

While the above description focuses on chemical fume hoods, the design aspects of the present invention can be applied to various ventilated enclosures in various industries and disciplines.

It should be understood, of course, that the foregoing relates to exemplary embodiments of the invention and that modifications may be made without departing from the spirit and scope of the invention as set forth in the following claims.

What is claimed is:

1. A ventilated enclosure comprising:

a vortex baffle mounted inside the ventilated enclosure that is a continuous, unbroken, vaulted structure that is symmetrical as viewed in profile, wherein front and rear edges of the vortex baffle form parallel lines that define a horizontal plane that is parallel to the plane of a work surface of the ventilated enclosure and perpendicular and tangential to a plane of an open face that is the sole means of communicating fluid from an outside to an interior of the ventilated enclosure; and a single exhaust slot disposed between the symmetrical vaulted interior vortex baffle and a rear housing of the ventilated enclosure, the single exhaust slot providing a sole fluid communication between the interior of the ventilated enclosure and an exhaust duct, wherein an interior height of the vortex baffle above the work surface of ventilated enclosure is equal to about 1.6 times a working depth of the ventilated enclosure;

the working depth of the ventilated enclosure is equal to a distance from the work surface to a lower edge of the vortex baffle at the single exhaust slot; and a height of an opening, extending vertically from the front edge of the vortex baffle, of the ventilated enclosure is equal to or less than the working depth of the ventilated enclosure wherein the opening provides the only flow of air into the ventilated enclosure during use thereof.

2. The ventilated enclosure of claim 1, wherein the symmetrical vaulted interior vortex baffle is an arc-shaped baffle.

3. The ventilated enclosure of claim 1, wherein the symmetrical vaulted interior vortex baffle is an angled baffle.

4. The ventilated enclosure of claim 3, wherein the angled baffle includes vertical components along a front and a rear of the angled baffle, slanted components extending from tops of the vertical components at a first angle, and a horizontal component interconnecting ends of the slanted components at a second angle.

5. The ventilated enclosure of claim 4, wherein the first angle and the second angle are each about 45 degrees.

6. The ventilated enclosure of claim 1, wherein the symmetrical vaulted interior vortex baffle is an angled baffle comprised of at least five flat panels that are approximately the same size.

7. A ventilated enclosure comprising:

a continuous, unbroken and symmetrical semi-circular vaulted interior vortex baffle mounted inside the ventilated enclosure, wherein the vortex baffle is symmetrical as viewed in profile; and a single exhaust slot disposed between a rear edge of the symmetrical vaulted interior vortex baffle and a rear housing of the ventilated enclosure, wherein:

the single exhaust slot provides a sole fluid communication between an interior of the ventilated enclosure and an exhaust duct;

an interior height of the vortex baffle above a work surface of the ventilated enclosure is equal to about 1.6 times a working depth of the ventilated enclosure;

the working depth of the ventilated enclosure is equal to a distance from a work surface to a lower edge of the vortex baffle at the single exhaust slot; and a height of an opening extending vertically from a front edge of the vortex baffle of the ventilated enclosure is equal to or less than the working depth of the ventilated enclosure, wherein the front edge of the vortex baffle is a top edge of an open face of the ventilated enclosure that provides the only flow of air into the ventilated enclosure during use thereof.

8. A ventilated enclosure comprising:

a continuous, unbroken and symmetrical vaulted interior vortex baffle mounted inside the ventilated enclosure, wherein the vortex baffle is symmetrical when viewed in profile;

a single exhaust slot disposed between a rear edge of the symmetrical vaulted interior vortex baffle and a rear housing of the ventilated enclosure; and a single opening permitting air to enter the ventilated enclosure, wherein a working depth of the ventilated enclosure, a ratio of an interior height of the ventilated enclosure to the working depth, and an opening height are chosen to provide a stable vortex in the ventilated enclosure when air is drawn out through the single exhaust slot, and wherein the symmetrical vaulted interior vortex baffle is an angled baffle comprised of at least five flat panels that are approximately the same size.

9. The ventilated enclosure of claim 8, wherein the first angle and the second angle are each about 45 degrees.

10. The ventilated enclosure of claim 8, wherein the interior height of the vortex baffle above the work surface of the ventilated enclosure is equal to about 1.6 times the working depth of the ventilated enclosure.

11. The ventilated enclosure of claim 8, wherein the opening height of the ventilated enclosure is equal to or less than the working depth of the ventilated enclosure.

* * * * *